United States Patent [19]

Bouffenie et al.

[11] 4,063,067

[45] Dec. 13, 1977

[54] FURNACE FOR HEATING A CIRCULATING GAS STREAM ESPECIALLY FOR PRODUCING MOLECULAR JETS

[75] Inventors: Jacques Bouffenie; Roger Campargue, both of Paris; Albert Recule, Igny, all of France

[73] Assignee: Commissariat a l'Energie Atomique, France

[21] Appl. No.: 594,033

[22] Filed: July 8, 1975

[51] Int. Cl.[2] ..... F24H 3/04

[52] U.S. Cl. ..... 219/374; 219/380; 219/381

[58] Field of Search ..... 219/373, 374, 375, 380, 219/381, 382, 400

[56] References Cited

U.S. PATENT DOCUMENTS

| | | | |
|---|---|---|---|
| 2,609,477 | 9/1952 | Borda et al. | 219/380 |
| 3,109,912 | 11/1963 | Cerulli | 219/381 |
| 3,270,182 | 8/1966 | Hynes | 219/374 X |
| 3,560,710 | 2/1971 | Fuellemann | 219/373 |

FOREIGN PATENT DOCUMENTS

| | | | |
|---|---|---|---|
| 2,203,701 | 8/1973 | Germany | 219/374 |
| 687,558 | 3/1965 | Italy | 219/374 |
| 985,091 | 3/1965 | United Kingdom | 219/374 |
| 210,281 | 3/1968 | U.S.S.R. | 219/374 |

*Primary Examiner*—Volodymyr Y. Mayewsky
*Attorney, Agent, or Firm*—Lane, Aitken, Dunner & Ziems

[57] ABSTRACT

A furnace for heating a circulating gas stream to high temperatures comprising a tubular resistance-type heating element in contact with a stream of gas which is circulated outside and then inside the element, at least one annular and coaxial thermal screens surrounded by a cooling circuit, a leak-tight support casing which communicates with the external region of the heating element, an end-cap screwed into the casing and forming a nozzle from which the hot gases are discharged, and pumping means connected to the space between the open end of the tubular heating element and the end-cap.

7 Claims, 3 Drawing Figures

FURNACE FOR HEATING A CIRCULATING GAS STREAM ESPECIALLY FOR PRODUCING MOLECULAR JETS

BACKGROUND OF THE INVENTION

This invention relates to a heating furnace for bringing a circulating gas stream to a very high temperature of the order of 3000° K. The invention applies primarily although not exclusively to the experimental equipment units which are intended to produce molecular jets by extracting and transferring in a high vacuum the axial portion of a supersonic jet which is discharged from a nozzle, this objective being achieved by making use of suitable diaphragms (divertors, collimators) designed to separate a series of adjacent chambers in which progressively higher degrees of vacuum are obtained. In equipment units of this type, the furnace can serve to vary the gas-generating temperature within the nozzle in a continuous manner from 300° to 3000° K and consequently to vary the energy of the molecules forming the molecular jet in proportion to said temperature. By combining this heating effect with the aerodynamic acceleration effect which takes place naturally within a supersonic jet of a mixture containing a high proportion of a light carrier gas (hydrogen or helium), it is possible to produce molecular beams having kinetic energies in the particularly interesting range of 0.05 to 40eV, for example.

Beams having this energy are of considerable interest in the field of fundamental and applied research; this energy range in fact corresponds to the energies employed in the majority of physico-chemical processes, in excitation, ionization and dissociation processes and also in interactions between gases and solids. The furnace aforementioned can also be employed in different fields such as researches in wind tunnels, aerodynamic lasers and so forth.

In the prior art, heating of the circulating gas is produced by Joule effect through small tubular reservoirs which are usually constructed of tungsten and the side walls of which serve as heating resistors. The gas is admitted and circulates continuously within the tubes and escapes in the form of a supersonic jet through a small orifice which performs the function of a nozzle.

Devices of this type are attended by a number of disadvantages: the alignments which are essential for the formation of the molecular jet are liable to be highly disturbed by expansion effects which modify the location of the discharge orifice to the nozzle; moreover, the dimensions of said orifice cannot be modified as is occasionally necessary according to the nature of the gas without changing the entire device. It is in fact very difficult to secure a demountable component to a tungsten tube which can be machined only with difficulty by reason of the extreme brittleness of tungsten; moreover, the evacuated tubular reservoir is capable of withstanding only pressures of fairly low value, especially at high temperature. Systems of this type cannot be employed for molecular jet generators which operate with a very high generating pressure of the order of $10^4$ Torr.

SUMMARY OF THE INVENTION

The present invention is directed to a heating furnace which makes it possible to combine with the circulation of the gas stream a temperature effect and a pumping effect in the vicinity of the gas outlet, the jet velocity which is proportional to the square root of the absolute temperature being thus considerably increased.

To this end, the heating furnace which is employed primarily for producing molecular jets comprises:

a tubular resistance-type heating element placed at least in contact with the gas stream which circulates externally of the heating element and then internally of said element, at least one annular and coaxial thermal screen which surrounds the heating element, at least one fluid-circulation cooling circuit which surrounds the thermal screens and the extremities of the tubular element, a leak-tight support casing which is supplied with a gas stream and communicates with the external region of the heating element, an end-cap constituting a nozzle which is screwed into the casing and is pierced by an orifice located opposite to the open heating element extremity from which the hot gases escape, pumping means connected to the annular peripheral portion of the space formed between said open extremity of the tubular heating element from which the gases escape and the end-cap, an electrical assembly for supplying electric current to said heating element.

In a preferential embodiment of the invention, the return of electric current is carried out by means of the external heating element which is connected to ground.

The tubular heating element is of tungsten, of graphite or of any other resistive element which has a high melting point and is inert with respect to the gas or the hot mixture, e.g. tantalum, molybdenum, niobium, rhenium and so forth.

BRIEF DESCRIPTION OF THE DRAWINGS

Further properties and advantages of the invention will become more readily apparent from the following description of exemplified embodiments which are given by way of explanation without any implied limitation, reference being made to the accompanying drawings, wherein.

DETAILED DESCRIPTION OF THE PREFERRED EMBODIMENTS

Figure 1:
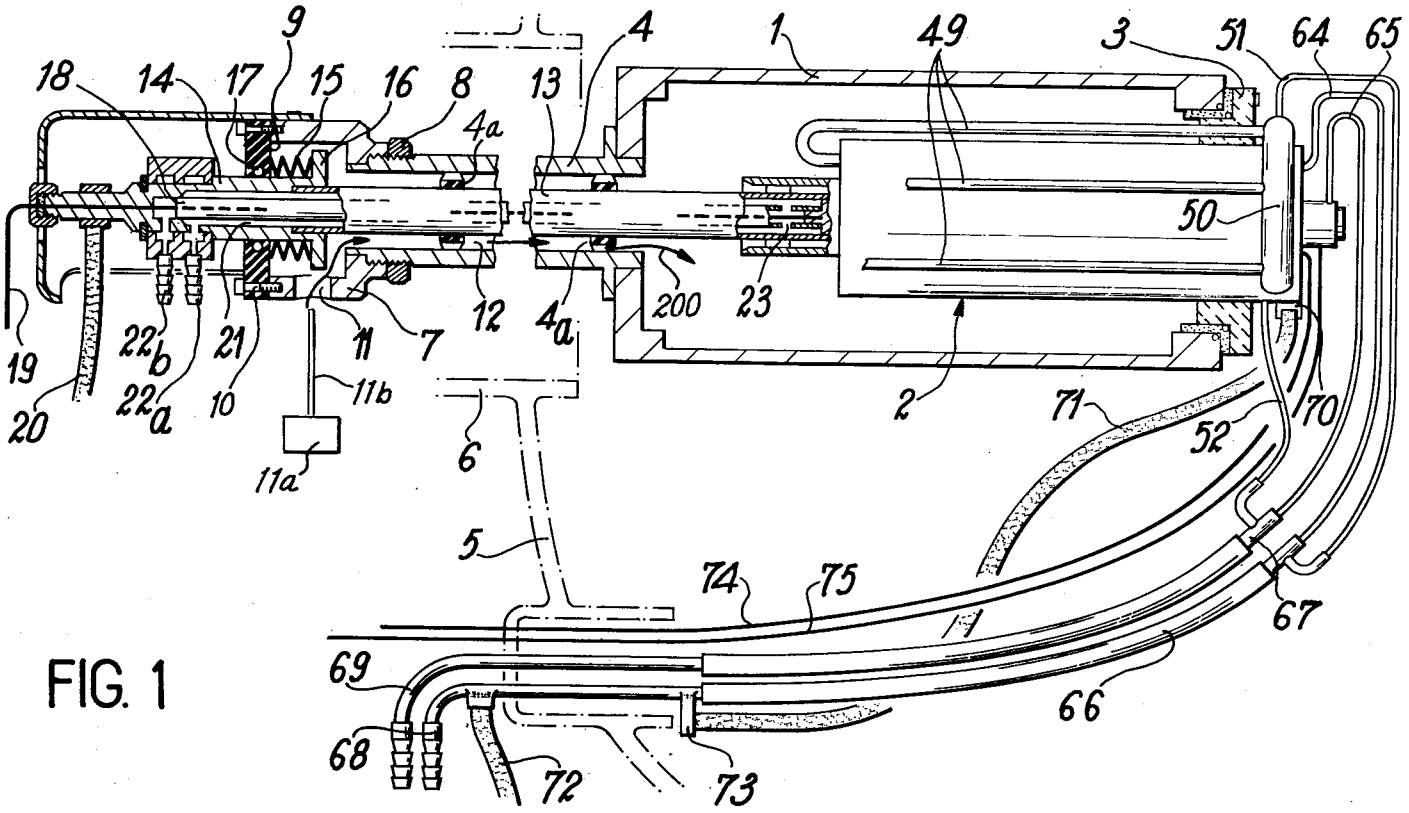
FIG. 1 is a diagrammatic view in elevation of the furnace under consideration.

There is shown in FIG. 1 a support casing which is designated by the reference 1 and within which is mounted a heating furnace proper as designated by the reference 2. The details of construction of said furnace will be explained in connection with FIGS. 2 and 3. At the end located on the right-hand side of the figure, said casing 1 is closed by an insulating end-plate 3 which supports the extremity of the furnace 2. The casing 1 is provided with a tubular extension 4 at the end located on the left-hand side. Said extension 4 is intended to pass through a duct 6 which is integral with the wall 5 of a vacuum enclosure containing the casing 1, the elements 5 and 6 being illustrated diagrammatically in chain-dotted lines in FIG. 1. At the end remote from the casing 1 the tubular extension 4 is rigidly fixed to a hollow sleeve 7 and this latter is clamped against the extremity of the extension by means of a nut 8. The sleeve 7 aforesaid is fitted with a closure plate 9 which is formed of electrically insulating material and rigidly fixed to the sleeve by means of screws 10. An opening 11 is formed in the lateral wall of said sleeve for introducing a gas stream under pressure from a source 112 via a conduit 116 into the interior of the tubular extension 4 at the extremity of this latter and causing said stream to pass into the casing 1. In the example primarily considered in which the heating furnace in accordance with the invention is applied to an apparatus for producing a "molecular jet", the gas stream aforesaid is a pure gas, a gas diluted in a light gas, or a gaseous mixture. This gas which is admitted into the sleeve 7 through the opening 11 thus circulates within the annular space 12 formed between the internal wall of the extension 4 and a metallic tube 13. The gas flow path follows the arrow 200. The tube 13 serves to conduct the necessary electric current to the resistance-type heating element of the furnace as will be described hereinafter. As shown in the drawing on the left-hand side, the tube 13 is rigidly fixed to a bushing 14, said bushing being adapted to pass through the plate 9 which closes the sleeve 7 and to permit ready adsorption of any differences in thermal expansion which may arise between said sleeve and the tube 13, this being achieved by mounting a spring element 15 between said plate 9 and an annular flange 16 of the bushing 14. A seal 17 permits displacement of said bushing 14 in sliding motion without impairing leak-tightness with respect to the interior of the sleeve 7. A second tube 18 is mounted coaxially within the tube 13 and is in turn traversed by a cable 19 connected to a thermocouple probe (not shown in FIG. 1) for checking and ascertaining that certain points which cannot be heated without incurring the risk of damage to the furnace in fact remain at temperatures which do not exceed approximately 200° C.

Electric current from a supply source (not shown) is supplied to braided conductor 20 which is secured to the extremity of the bushing 14, said bushing being in turn in electrical contact with the tube 13. Insulating ring, such as rings 4*a*, are advantageously mounted between the tube 13 and the tubular extension 4 which, in turn, is connected to ground together with the casing 1. Finally, in order to permit internal cooling of said tube, the annular space 21 formed between this latter and the tube 18 carries a circulation of coolant water, which is introduced into the apparatus by means of a hose-connector 22*a* mounted on the bushing 14, flows into the interior of the tube 18 through orifices 23 formed at the right extremity of the tube, then returns towards the bushing 14 to be discharged from the bushing through a second connector 22*b*.

Figure 2:
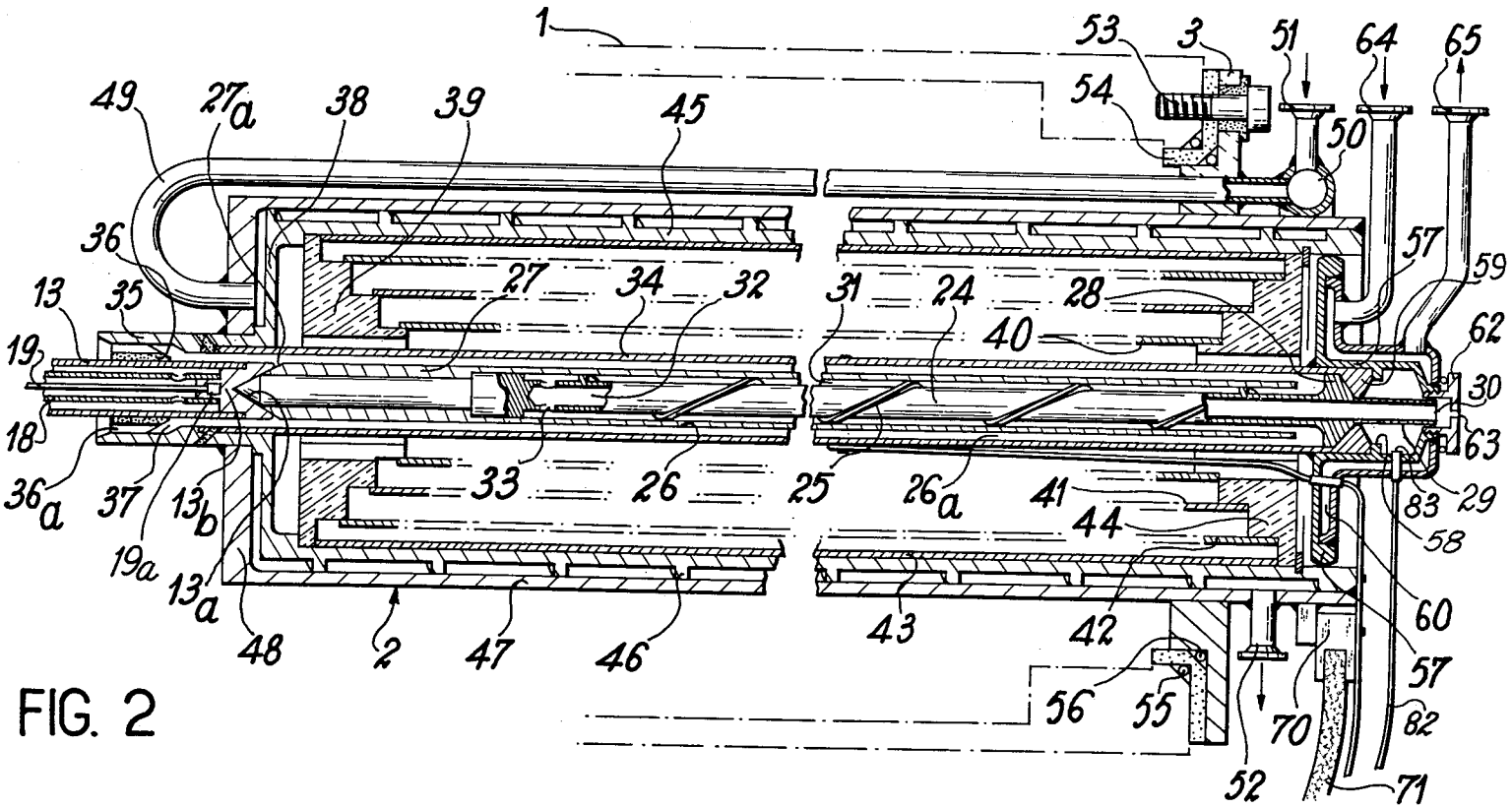
FIG. 2 is a longitudinal sectional view of the heating element, of the thermal screens and of the devices for cooling a graphite furnace in accordance with the invention.

FIG. 2 illustrates to a larger scale the constructional detail of the furnace 2 which serves to heat the gas. Said furnace is mainly composed of a resistance-type heating element constituted by a graphite tube 24, a helical bead 25 being machined on the external surface of said tube. A second graphite tube 26 is mounted externally of the tube 24 in coaxial relation therewith. The extension 27 of said second tube terminates in a cone-shaped portion 27*a* which is capable of engaging and centering the tubes 24 and 26 within a conical opening 13*a* of a member 13*b* which is secured to the extremity of the tube 13. The tube 18 which is mounted coaxially with said tube 13 is rigidly fixed to said member 13*b*. At the extremity which is located on the right-hand side, the graphite tube 24 is provided with a transverse enlarged head portion 28 having an axial extension in the form of a small graphite tube 29. The gas which is discharged from the tube 24 flows out through the small graphite tube 29 after having circulated first within the helical space 31 formed between said tube 24 and the internal wall of said tube 26, then secondly and in the reverse direction within the internal portion 32 of the tube 24, the regions 31 and 32 being permitted to communicate with each other through the surface of the tube 24 by means of through-holes 33.

The apparatus comprises a third tubular element 34 which is also placed in coaxial relation with the tubes 24 and 26. The extension of the tubular element 34 at the end remote from the head portion 28 is rigidly fixed to an end-piece 35 which partially surrounds the corresponding extremity of the tubes 13 and 18. Provision is made for suitable electrical insulation between the tube 13 which supplies current to the tubes 24 and 26 and to the end-piece 35, especially by mounting rings 36 through which are formed longitudinal passages 36*a* so as to allow the gas to penetrate into the furnace.

The gas is in fact admitted through the orifice 11 into the annular space 12 (as shown in FIG. 1), passes into the casing 1 and then flows first through the orifices 36*a*, then through passages 37 and fills the annular space 26*a* formed between the tubes 26 and 34. Said gas is returned at the extremity of the tube 26 into the helical space 31, passes through the holes 33, then flows through the space 32 within the tube 24 in the opposite direction and finally passes through the opening 30 of the small tube 29.

In order to ensure that the heat gained by the gas as it circulates in contact with the heating tubed 24 is not lost at this point by radiation and convective transfer to the exterior, the furnace in accordance with the invention is advantageously provided with a thermal protection device. Accordingly, the end-piece 35 is rigidly fixed to a transverse flange-plate 38, which serves to position with respect to the tubes 26 and 34 an insulating support member 39 for a series of coaxial cylindrical screens designated respectively by the reference numerals 40, 41, 42 and 43. The screens are also secured in position at their opposite extremities by means of a member 44 which is similar to the member 39. The outer screen 43 is in turn surrounded by a sheath 45 provided with an external helical rib 46 for determining in conjunction with a coaxial shell 47 a continuous helical passage in which provision can be made for a circulation of coolant water. The shell 47 has an end-plate 48 which closes the furnace 2 and is traversed by pipes 49, only one pipe being visible in FIG. 2 whilst a number of pipes are shown diagrammatically in FIG. 1. The pipes 49 are connected to a common water inlet manifold 50 which is in turn connected to a supply circuit by means of a branch 51. The water which is drawn from the manifold 50 through the pipes 49 is discharged behind the flange-plate 38 and then circulates within the helical passage formed between the sheath 45 and the shell 47 before being finally discharged through an outlet branch 52. The furnace 2 as a whole is finally mounted through the end-plate 3 which is rigidly fixed to the casing 1 by means of fixing screws 53, thus making it possible to clamp insulating spacer members 54 and seals 55 and 56 between the end-plate and the leak-tight casing.

In order to carry out the cooling of the head portion 28 of the heating element 24 in addition to the cooling of the thermal screens in the central portion of the furnace as mentioned in the foregoing, the apparatus comprises a second cooling circuit which is independent of the circuit described earlier. The second cooling circuit essentially comprises a closed casing 57 which is positioned with respect to right end of the tube 34 by means of an annular collar 58 which is abuttingly applied against a boss 59 provided at the end of the tube 34. The internal region 60 of the casing 57 is also delimited by an end-cap 62 provided with a discharge orifice 63 for the gas jet produced. Coolant water is supplied to the region 60 by means of an inlet branch 64 and discharged through an outlet branch 65. The two cooling circuits employed are advantageously connected outside the furnace to common supply and discharge pipes 66 and 67, as illustrated more especially in FIG. 1. Said pipes 66 and 67 are connected to the exterior of the enclosure 5 to hose unions 68 and 69 which provide a connection with a supply station (not shown in the drawings).

As stated in the foregoing, the supply of electric current to the heating tubes 24 and 26 is provided from a source (not shown) via the braided conductor 20, the bushing 14 and the tube 13. The return of the current then takes place through the casing 1 of the apparatus itself and especially through the sheath 45 and the shell 47 by means of a lug 70 providing a connection with a metallic braided conductor 71 which is in turn connected to the ground point of the apparatus. Other grounding braided conductors of the type designated in particular by the reference 72 are provided on the supply pipes 66 and 67, the braided conductor 71 being connected to the conductor 72 if necessary through the coolant water circuit by means of a junction lug 73 carried by the pipe 66 (FIG. 1).

The equipment of the apparatus is completed by means of thermocouple probes 74*a* and 75*a* of known construction connected to the electrical heads 74 and 75, respectively for checking and ensuring that certain points which could not be heated without hazard to the furnace remain at temperatures below approximately 200° C.

The furnace is provided with a small pipe 82 which opens into the space surrounding the small tube 29 formed between the extremity of the heating element 24 and the end-cap 62. Pumping means not shown in FIG. 2 and connected to said pipe 82 serve to pump the gases into said space. This pumping into the cavity improves the device to a considerable extent, mainly in regard to the effective temperature of the gas stream which passes through the orifice 63 of the end-cap 62.

The operation of the heating furnace in accordance with the invention can readily be deduced from the foregoing. The gas which is admitted into the casing 1 through the annular space 12 formed between the extension 4 and the tube 13 penetrates through the passages 37 into the region 26*a* which is delimited by the tubes 26 and 34, comes into contact with the heating element by first passing over the external surface at 26*a*, then flows through the helical space 31 and finally returns towards its opposite extremity through the region 32 after passing through the holes 33. Said gas which is thus heated to a high temperature then escapes from the tube 24 through the opening 30 of the small tube 29, then through the orifice 63 formed in the end-cap 62. It should be noted that the region located within the interior of the casing 1 is continuously isolated from the gas outlet by virtue of the leak-tightness achieved by the seals 55 and 56. In the example described, the gas pressure which is usually adopted at the inlet of the apparatus and at the furnace inlet is approximately 2 bars but can be of a much higher value.

The electric current required for heating which arrives is supplied through the braided supply conductor 20 is transmitted by the bushing 14 to the tube 13, (FIG. 1) then by the contact established between the members 13*a* and 27*a* to the heating tube 24 (FIG. 2). By virtue of the resistance of the tubes 24 and 26, said electric current produces a substantial temperature rise of these tubes through which the gas flows in the manner indicated earlier. The electric current returns to ground after passing through the tubes 24 and 26 and through the tube 34, the sheath 45, the shell 47 and the casing 1 being connected together to the braided conductor 71. On the other hand, the tube 13 is insulated from ground by means of the spacer member 56 which is formed of suitable material such as "Celoron", for example, and also by means of the end-plate 3 which is advantageously formed of "Altuglass". The thermal screens 40, 41, 42 and 43 ensure efficient protection against the radiation of the heating tubes 24 and 26. These screens are preferably formed of molybdenum and suitably centered by means of the insulating members 39 and 44 which are formed of alumina. Cooling of the different parts of the furnace is obtained by means of the circulation systems which are illustrated; the first system comprises the manifold 50 and the pipes 49 for cooling the central portion; the second circulation system is constituted by its casing 57 which serves to protect the head of the heating element, the gas which is heated to a high temperature being intended to escape through said head; finally, the third circulation system provided around the current supply tube 13 ensures protection of this tube by means of the region 21 (as shown in FIG. 1).

The different thermocouples employed finally make it possible to ensure that different delicate portions of the furnace remain in the cold state, especially at the rear of the heating element by means of the probe 19*a* (FIG. 2) coupled to the cable 19 (FIG. 1), at the outlet of said element by means to the probe 75*a* connected to the lead 75 and finally in the central region by means of the probe 74*a* connected to the electrical lead 74.

The table given below clearly brings out the efficiency of the pumping operation carried out by the tube 82 within the annular peripheral region located between the extremity of the heating element and the end-cap. The table records the temperatures obtained with and without pumping whilst all the other parameters remain constant.

| Gas | Diameter of the orifice 63 | Temperature obtained | |
|---|---|---|---|
| | | Without pumping | With pumping |
| Nitrogen | 0.25 mm | 560° K | 1380° K |
| Hydrogen | 0.25 mm | 510° K | 1600° K |
| Argon | 0.25 mm | 950° K | 2100° K |

By virtue of the combination of its different elements, this type of heating furnace makes it possible to overcome the disadvantages of furnaces of the prior art as follows:

a. the complete furnace is contained within a shell at room temperature by means of a water-cooled "jacket", for example, and the use of a good conductor such as copper. Cooling of this type is carried out up to the nozzle orifice, said orifice being located in a small member (end-cap 62) and this latter being screwed onto the cooled copper block which constitutes the enclosure. No disturbance is thus liable to take place in the alignments which are necessary for the formation of a high-quality molecular jet.

b. it is easy to change the dimensions of the orifice (its diameter in the case of a system of revolution), the end-cap 62 in which said orifice 63 is formed being readily removed.

c. the pressures are exerted both inside and outside the heating resistors which are of tubular design. The same applies to the cooling shell except in the vicinity of the nozzle. The furnace is thus capable of withstanding very high pressures since all the walls of the enclosure on which said pressures are exerted are at room temperature, thus making it possible to employ stainless steel.

A novel and remarkable feature of the present invention lies in the pumping which is carried out in the peripheral annular region located immediately upstream of the end-cap orifice. As has already been noted earlier, this pumping achieves a considerable improvement in the properties of the furnace and in particular the temperature of the axial stream which forms the supersonic jet. In the present state of knowledge, there is no existing theory which permits an unambiguous explanation for the highly efficient part which is played by this pumping process. It can, however, be given different interpretations: a first is that the pumping action produced on the periphery of the gas stream has the effect of removing the coldest portions of the gas stream, namely the peripheral portions of the stream which have previously been in contact with the cooled walls, thus increasing the mean temperature. Another interpretation is that the pumping action considerably reduces the residence time and consequently the heat exchanges between the gas which escapes from the heating element and the cold walls. A further concept is that the reduction of pressure within the space formed between the heating element and the end-cap reduces the thermal conductivity of the gas and thus prevents cooling as the gas passes through this critical portion of the enclosure.

It has been observed that the pumping efficiency was higher as the diameter of the orifice 63 of the end-cap 62 was smaller.

Figure 3:
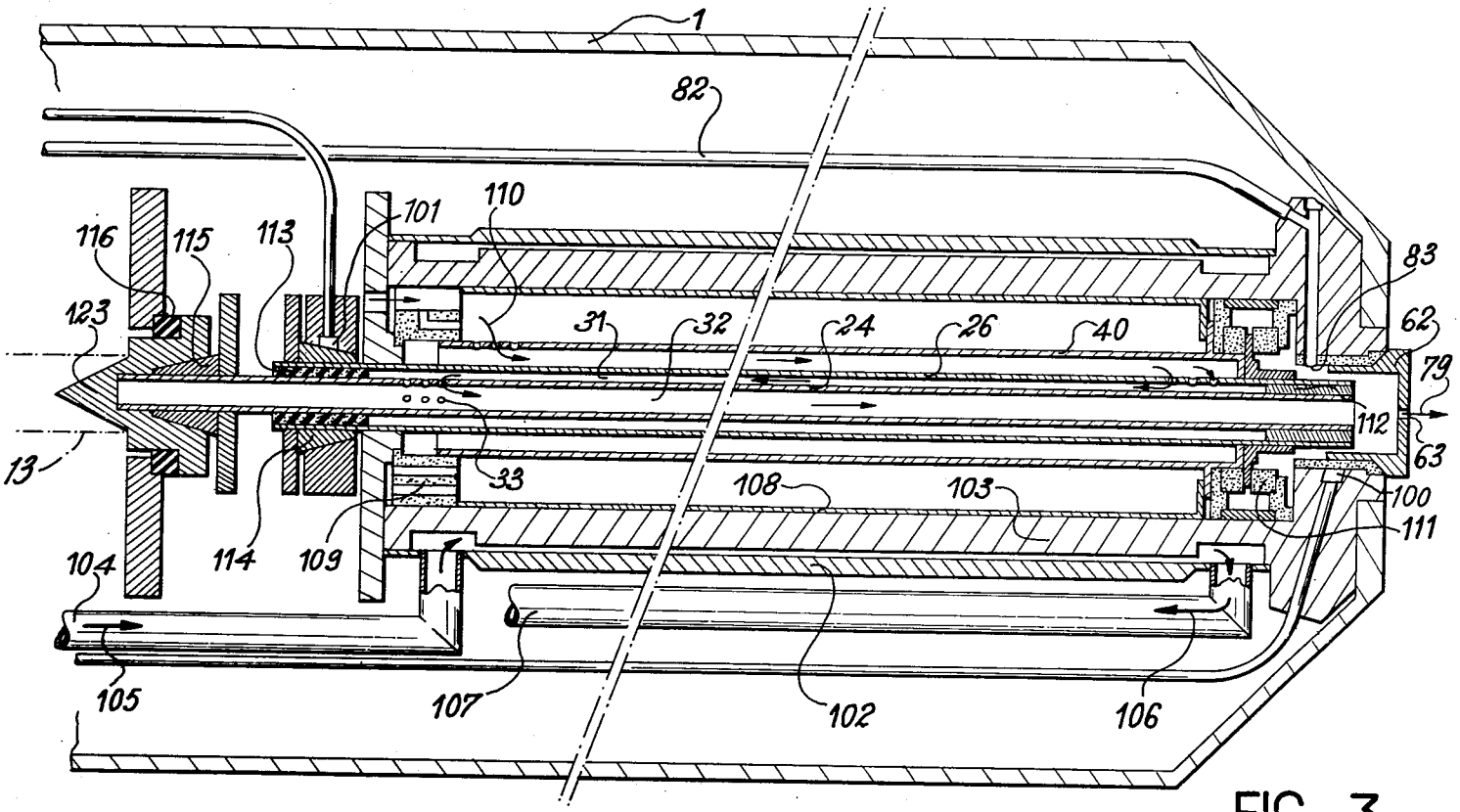
FIG. 3 is a longitudinal sectional view of a preferential embodiment of a furnace having a tungsten element in accordance with the invention.

A preferential embodiment of the furnace in accordance with the invention is shown in the sectional view of FIG. 3. This alternative form of construction produces higher gas outlet temperatures than those of the first furnace. The general arrangement is the same as that of the first furnace, the graphite elements 24 and 26 being replaced by tungsten elements. The furnace contained within the outer casing 1 which is constructed for example of stainless steel in order to be capable of withstanding high pressures terminates in the end-cap 62 provided with the orifice 63 through which the gas is discharged in the direction of the arrow 79. This furnace has an outer cylinder 102 and a centering cyclinder 103, this latter being cooled by a circulation of water which is admitted in the direction of the arrow 105, passes through the gap between the two cylinders 102 and 103, then passes out in the direction of the arrow 106 through the pipe 107. The centering cylinder 103 contains the system for heating the circulating gas. This heating system is constituted by at least one thermal screen 40 pierced by openings through which the gas contained in the enclosure 101 penetrates in the direction of the arrow 110. The thermal screen 40 of molybdenum, for example, permits both the passage and preheating of the cold gases. The screen 40 is maintained in position at one extremity by means of an insulating ring 109 which is pierced so as to permit the admission of the gas contained within the enclosure 101. At the other end of the thermal screen 40, insulating rings such as the ring 111 serve to secure and center a first tungsten tube 26 which constitutes the resistance heating assembly of the furnace in conjunction with a second tube 24 which is also of tungsten. These two tubes are connected electrically by means of a conducting ring 112 of tungsten and secured in position at the other end by means of an insulating ring 113. These two rings both ensure a suitable degree of leak-tightness. The two tungsten tubes are clamped against both end-plates by means of cones 114 and 115, the cone 115 being electrically insulated by means of the ring 116. The electric current is supplied to the cone 123 by means of a cooled copper tube 13, as was the case with the furnace of FIG. 2. The return of current to ground takes place in the same advantageous manner as in the furnace of FIG. 2.

In FIG. 3, auxiliary pumping is carried out through an annular space located in the vicinity of the outlet of the tube 24. The gas pumped at 83 is discharged through the pipe 82. The thermocouples 100 and 101 make it possible to check whether certain points in fact remain at temperatures in the vicinity of room temperature (or do not exceed approximately 200° C).

All the connections for water, electric current, gas and thermocouples are established at the rear of the furnace and within the tube which forms an extension of the casing 1. Thus the furnace can be completely assembled before being placed on a molecular jet generator.

The table given below provides a comparison between the temperatures obtained with and without auxiliary pumping whilst all the others parameters remain constant.

| Diameter of the orifice 63 of the end-cap 62 | Gas | Temperature obtained | |
|---|---|---|---|
| | | Without pumping | With pumping |
| | Argon | 1300° K | 2600° K |
| 0.25 mm | Argon | 1600° K | 3000° K |
| | Argon | 670° K | 2700° K |
| | Hydrogen | 900° K | 1720° K |
| 0.1 mm | Hydrogen | 1200° K | 2200° K |
| | Hydrogen | 1420° K | 2450° K |

As has already become apparent from the foregoing, the invention is clearly not limited to the two examples of construction which have been more especially described with reference to the accompanying drawings but extends on the contrary to all alternative forms.

We claim:

1. A furnace for producing high-temperature, gaseous molecular jets, comprising:

a fluid-tight support casing;

a tubular, resistance-type heating assembly disposed within said casing and having an open end portion positioned adjacent to one end of said casing;

containment means coaxially disposed about said heating assembly and defining an enclosed space about said heating assembly;

means for supplying an electric current to said heating assembly for energizing said heating assembly;

an end cap on said casing adjacent to said open end portion of said heating assembly, and having a nozzle orifice positioned opposite said open end portion of said heating assembly for the discharge of heated gas from said casing;

means for providing a gas stream into the enclosed space defined by said containment means, said gas stream being circulated externally and then internally of said heating assembly, and then being discharged from the open end portion of said heating assembly;

an annular thermal screen disposed coaxially with and surrounding said heating assembly to contain the heat generated by said heating assembly;

means for circulating cooling fluid around said thermal screen and around the extremities of said heating assembly to control the temperatures thereof; and pumping means operatively connected adjacent to said open end portion of said heating assembly to remove a portion of said heated gas stream prior to its discharge through said nozzle orifice to increase the temperature of the discharged gas stream.

2. A furnace according to claim 1, wherein said heating assembly includes a graphite tube provided with an external helical rib and covered by a second concentric tube.

3. A furnace according to claim 2, further including electrically-insulating plates closing the ends of said casing and having means for supporting said heating assembly, said thermal screen, and said means for circulating cooling fluid.

4. A furnace according to claim 3, wherein said insulating plates are provided with insulating members for supporting and centering said thermal screen.

5. A furnace according to claim 1, wherein said heating assembly includes at least one tube of tungsten.

6. A furnace according to claim 1, wherein said means for supplying an electric current includes:

a conductive tube having one end portion in electrical conductive contact with the other end portion of said heating assembly;

a conductive bushing fixed to the other end portion of said conductive tube; and an electrical supply cable attached to said bushing.

7. A furnace according to claim 1, wherein said means for supplying an electric current includes an electrically-grounded, metallic tube supported by said casing, said tube surrounding and in electrical contact with said heating assembly.

* * * * *